United States Patent [19]

Schwartz

[11] 3,991,954

[45] Nov. 16, 1976

[54] THREAD TENSION CONTROL APPARATUS FOR TEXTILE MACHINERY

[75] Inventor: Hermann Schwartz, Pfaffikon, Switzerland

[73] Assignee: Siegfried Peyer, Bach, Switzerland

[22] Filed: Aug. 13, 1975

[21] Appl. No.: 604,229

[30] Foreign Application Priority Data

Sept. 6, 1974 Switzerland ..... 12160/74

[52] U.S. Cl. ..... 242/150 M; 66/146; 226/195

[51] Int. Cl.[2] ..... B65H 59/22

[58] Field of Search ..... 242/45, 75.2, 147 M, 242/150 M; 66/146; 87/61; 112/254; 139/212, 218; 226/195

[56] References Cited

UNITED STATES PATENTS

| | | | |
|---|---|---|---|
| 2,907,535 | 10/1959 | Mindheim et al. | 242/150 M |
| 2,912,185 | 11/1959 | Vossen | 66/146 X |
| 3,351,296 | 11/1967 | Frei | 242/147 M X |
| 3,372,888 | 3/1968 | Eppendahl | 242/150 M |

*Primary Examiner*—Richard C. Queisser
*Assistant Examiner*—Charles Gorenstein
*Attorney, Agent, or Firm*—Flynn & Frishauf

[57] ABSTRACT

A pair of pressure disks through which the thread may pass are pressed together by a controllable electromagnetic force generated by a pressure electromagnet acting on at least one of the disks. The thread is passed over an oscillating lever which is urged by the tension of the thread from a first position to a deflected position and, when in the deflected position, closing an electrical contact which opens the circuit to the pressure electromagnet acting on the disks to return the lever to the first position, thus opening the contact. The magnetic force of a lever reset magnet is adjustable. The interrupted signal generated by the opening and closing of the contacts as the thread deflects the lever and it is reset by the electromagnetic force is used to control the coil current through the pressure electromagnet so that the pull-off tension will always be dynamically varied in dependence on changes of thread characteristics, wear of the pressure disks and the like due to control of the actual pressure exerted by the pressure disks transferred to the oscillating lever.

8 Claims, 3 Drawing Figures

THREAD TENSION CONTROL APPARATUS FOR TEXTILE MACHINERY

CROSS REFERENCE TO RELATED APPLICATION

U.S. application Ser. No. 574,399, filed May 5, 1975, now U.S. Pat. No. 3,938,119 of Feb. 10, 1976. assigned to the assignee of the present application.

The present invention relates to thread tension control apparatus for textile machinery, and more particularly to control the tension of thread being pulled through thread brake formed of a pair of relatively movable pressure plates or disks, the distance or contacting pressure of the disks being adjustable by a pressure electromagnet.

Various textile machines use a multiplicity of threads which are simultaneously worked on. For example, warp beams have been constructed which supply up to 2500 single-thread warp threads. Each one of these warp threads must be pulled off the warp beam with the same thread tension. It is thus necessary to control the pull-off tension of each one of these threads by passing each thread through a thread brake.

Thread brakes used in machines having a large number of threads or yarns have previoulsy been proposed, in which the thread or yarn passes between a pair of disks, the thread being subjected to tension due to the frictional resistance as the thread is being pulled between the disks. The desired value of the thread tension is obtained by applying a load or force acting from one disk to the other, for example by putting weights on one of the disks and locating them vertically. Thread tension can also be controlled by means of a spring.

If a textile machine of this type is re-threaded, that is, if threads of different quality or composition are used, the thread tension may be changed, or the thread brakes may be changed. All of the thread brakes, singly, have to be adjusted to the new value. This may require labor of many hours.

Electromagnetically acting thread brakes have been proposed in which a magnetic field is provided to attract an upper ferromagnetically active brake disk towards a lower, ferromagneticlly inactive thread disk. The electromagnetic force of attraction determines the engagement pressure, and hence the braking action and tension applied to the yarn as it is pulled from between the disks. The voltage applied to the magnet coil is roughly proportional to the thread tension. Such brakes can be connected electrically in parallel to a central supply source. Upon change of thread tension or thread consistency, it is only necessary to change the source to a different value and the multiplicity of thread brakes is automatically re-adjusted (see, for example, U.S. Pat. No. 3,110,091).

Such thread brakes permit rapid adjustment of the tension of a large number of threads. They are, however, subject to some difficulties. The magnetic attractive force acting on the upper thread brake is highly dependent on the distance between the electromagnet and the brake disk. If the thread thickness changes, that is, if once a thinner thread is passed between the disk and then a heavier one, the change in distance of the magnetically active disk to the magnet no longer permits direct proportionality between applied voltage to the magnet coil and the resulting thread tension. Dirt, loose remnants of thread, fluff, dust, and other contaminants between the brake disks may have similar effects.

Central adjustment of a large number of thread brakes introduces one major error into the system: The voltage which is set by the central supply source for all the thread brakes is measured at a volt meter; the scale of this volt meter may be graded in thread tension values — in grams — rather than in volts, in dependence on the electrical effect of the thread brakes. The braking effect of the thread brakes is not, however, reliably proportional to the voltage. Thus, such a command value adjustment does not necessarily result in an actual thread tension as desired. The actual thread tension depends on many factors which are not controllable by a central voltage source. The frictional resistance generated by pressure between a pair of brake disks — to which the thread tension will correspond — depends on the material of the thread and the condition of the brake disks as well. Thus, different thread materials, such as wool, cotton, and man-made artificial fibers have different friction; any one of these materials may be subjected to surface treatment with oil, paraffin, brighteners, and the like, which greatly affect the frictional coefficient of the thread with respect to the disks. Dirty or worn thread brake disks further influence the frictional coefficient of the thread. A command value set in accordance with the scale thus may vary widely from the actual pull-off tension of any individual thread passing through an individual thread brake. Changes from the command value may also result during operation, for example due to poorly wound spools, deposits of dirt, lubricant, grease, changes in humidity, accumulation of fluff, and the like.

A centrally adjusted electromagnetic thread brake can be used effectively only if the actual pull-off tension value and the command value can be compared, and a control circuit can be devised so that the braking action will rapidly change back to the commanded value.

It is essential that the thread brakes, and the system in which they are used, be inexpensive due to the large number of such elements in any one textile machine. This is one of the reasons why proposals for electronically controlled thread brakes did not find wide commercial acceptance since costs for large numbers of such brakes installed in textile machinery became excessive.

It is an object of the present invention to provide a thread brake system which is simple and inexpensive, so that it can be applied in large numbers to existing textile machines, and in which a command value and an actual tension value can be compared and a control circuit then can control the braking action so that it will accurately represent the commanded value.

SUBJECT MATTER OF THE PRESENT INVENTION

Briefly, an oscillating lever is engaged by the thread and urged by the tension of the thread from a first position into a deflected position. A reset electromagnet acts on the lever adjustably controlled by a voltage source in dependence on desired commanded tension to move the lever counter the deflected position back to the first position, when energized. The lever is associated with electrical switch contacts, movable between open and closed position as the lever moves from first to deflected position. A control circuit is connected to the coil of a pressure electromagnet, and connected to and controlled by the switch contacts to be respectively energized and de-energized as the lever moves between deflected and first position under the respective action of increased thread tension, moving the lever to deflected position and decreased thread tension permitting the reset magnet to move the lever to the first position, opening the contacts which, in turn, causes energization of the pressure magnet. The lever, thus, continuously oscillates, causing interrupted energization of the electromagnet, the duty cycle of operation of the electromagnet being a measure of the pull-off tension. The duty cycle thus is directly controlled by the tension of the thread as it is being pulled off.

The operation of the system is reliable, while permitting simple and thus inexpensive construction of the system as well as of the thread brake itself. With only little additional circuitry it is possible to add to each thread brake a thread breakage sensor, or a stop motion device. In accordance with a feature of the invention, a further control circuit is connected to the contacts of the lever which evaluates the oscillating movement thereof and provides an alarm signal upon cessation of oscillations.

The invention will be described by way of example with reference to the accompanying drawings, wherein.

Figure 1:
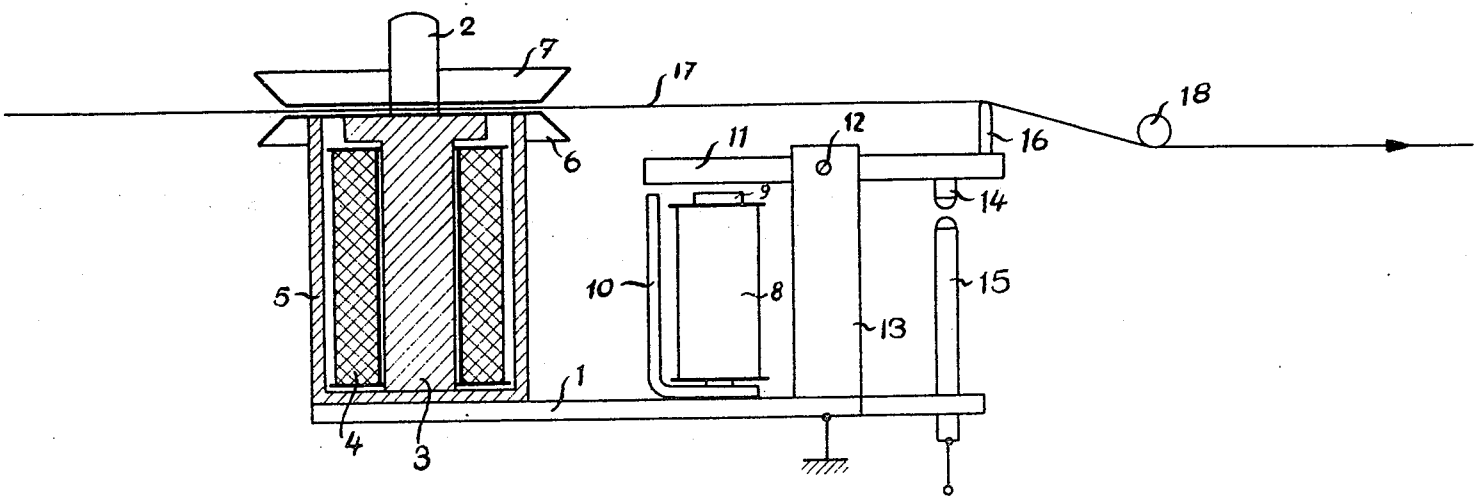
FIG. 1 is a highly schematic side view of the thread tension control apparatus.

A common base plate 1 (FIG. 1) has the yoke 5 of an electromagnet having a coil 4 and a central core 3 secured thereto. Yoke 5 is formed in the shape of an outer jacket. A cylindrical pin 2, for example made of ceramic material, is set into the core 3. A thread 17 is slightly deflected or bent about the pin 2. Two brake disks 6, 7 are placed on pin 2; the brake disks 6, 7 have up-turned edges, that is, they are dish-shaped and are formed with a central opening slightly larger than the diameter of pin 2, to receive pin 2 with some play. The lower brake disk 6 is magnetically inactive and, for example, may be made of bronze sheet metal of about 0.5 mm thickness, with a hard chrome cover. The upper brake disk 7 is made of magnetically responsive material, for example sheet steel of about 0.5 mm thickness, also coated with a hard surface, for example a hard chrome plating. The magnetic attractive force generated by the magnet 3, 4, 5 thus acts only on the upper brake disk 7. A certain distance pertains between the electromagnet 3, 4, 5 and disk 7 which is defined by the fixed value represented by the thickness of brake disk 6 and a variable value represented by the thickness of thread 17.

The tension-sensing system is located to the right of the brake magnet assembly and includes a forked frame 13 in which a flat double-armed lever 11 is journalled, approximately centrally by a shaft 12. The right free end of lever 11 carries a contact 14 at its lower side, located opposite a fixed contact 15 secured to the base plate 1 and carried there through in insulating relationship. A ceramic thread guide element 16 is located at the upper side of the lever at the arm thereof carrying contact 14. The thread 17 passes over guide element 16 with slight deflection, or bending thereover, as determined by a thread guide element 18. The sine of the angle of deflection of the thread determines the tension force exerted by the thread 17 on the element 16. To the left of fork 13 is located a coil 8 which has a central core 9 and a yoke 10. The lever 11 is magnetically responsive to cooperate with the electromagnetic assembly formed of coil 8, core 9 and yoke 10.

The lever 11 is in balance if the thread 17 is not tensioned at all (that is, slack, or is absent) and coil 8 is de-energized. The lever itself may be journalled in pin bearings, or may be held by a flexible suspension strap; the operation of the system is not affected by the particular suspension or support of the lever 11 in the fork 13.

Figure 2:
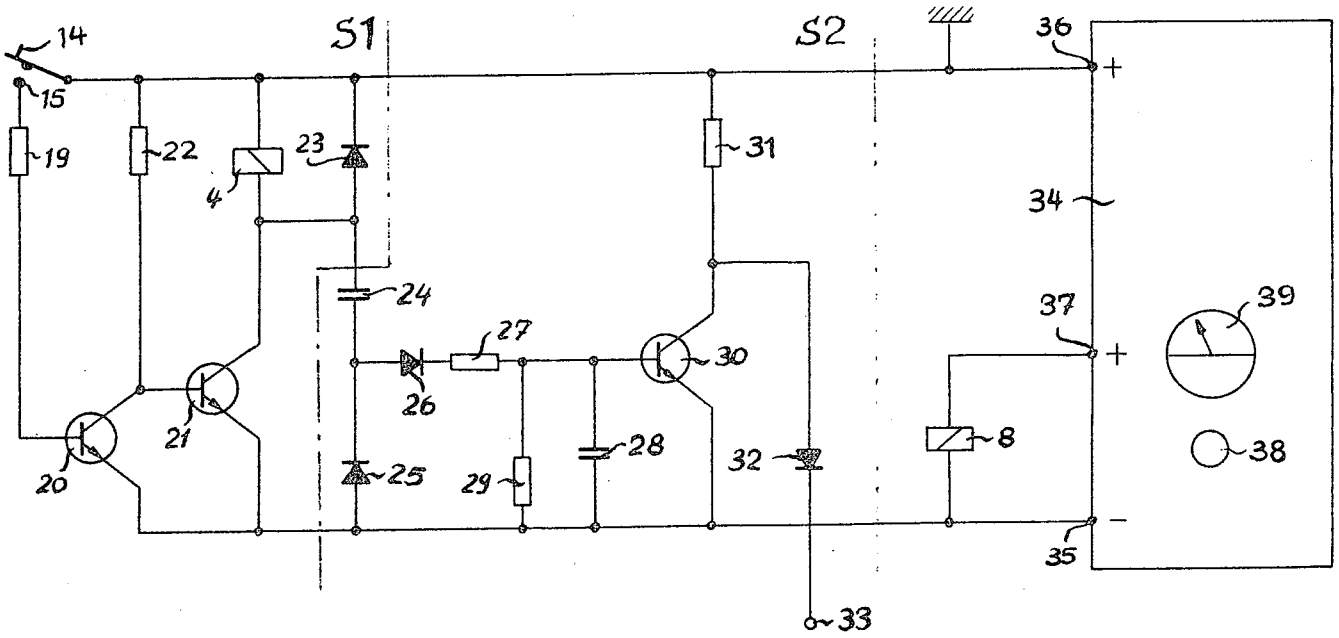
FIG. 2 is a circuit diagram for the apparatus of FIG. 1.

The pressure electromagnet system formed of magnets 3, 4, 5 and brake disks 6, 7, as well as the reset electromagnet system formed of coil 8, core 9 and yoke 10, as well as the contacts 14, 15 are included in a control circuit S1 (FIG. 2). This control circuit further includes a supply and command unit 34, having common supply terminals 35, 36, as well as a controlled voltage terminal 37, the level of which can be controlled by an adjustment knob 38. A meter 39 is also provided.

The controlled voltage 37 is applied to the reset coil 8 of the magnet system 8, 9, 10. The contacts 14, 15 connect the coil 4 of the brake electromagnet to the fixed voltage between terminals 35, 36. The contacts 14, 15 do not directly switch the coil 4, but rather contacts 14, 15, to prevent wear thereon, are connected in a transistor amplifier incuding transistors 20, 21 connected to and operating as a switching amplifier. Contact 15 is connected through a resistor 19 to the base of transistor 20, the collector of which is connected to a collector resistor 22 and to base of transistor 21. The collector-emitter path of transistor 21 is connected to the coil 4 of the brake pressure electromagnet system; a free-wheeling diode 23 is connected in parallel to coil 4.

Operation: Let it be assumed that contacts 14, is are open. Transistor 20 is blocked, and transistor 21 is conductive, and the full voltage between terminals 35, 36 is connected to coil 4. The energized coil 4 will, by magnetic attraction, pull the disk 7 towards disk 6, thus pinching thread 17 between disks 6, 7. Transistors 20, 21 are provided to reduce the current flowing over contacts 14, 15 and the shaft journal 12. This current may be in the order of about 2 micro amperes; even high contact resistances at the contact pair 14, 15 or at the suspension of the lever 11 do not interfere with proper operation of the circuit. The voltage set by control knob 38 which, for example, controls an adjustable voltage divider, or potentiometer, connected between terminals 35, 36, provides an adjustable voltage to magnet coil 8 which provides the effective reset force for the armature, that is, the arm of the lever 11 of the magnet system 8, 9, 10. This voltage can be read on the scale of meter 39; this scale may be graduated in electrical voltage values, or in thread tension values, for example in grams, corresponding to a command tension value. It would be possible, of course, to use springs to reset the lever 11 if only one such element, or a small number are used. Textile machines use, however, frequently a large number of such thread brakes which then can all be connected in common to unit 34 at terminals 35, 36, 37.

OPERATION

If the thread 17 is moved in the direction of the arrow in FIG. 1, pressure will be generated on the element 16 of lever 11. when this pressure exceeds the reset force of magnet 8, as set by adjustment knob 38 and applied at terminal 37, contacts 14, 15 will close. Transistor 20 will thus receive base current over resistor 19, and become conductive, thus draining base current from transistor 21 which will block. Coil 4 will be effectively disconnected and its magnetic attractive force acting on brake disk 7 will decrease until tension of the thread has decreased such that the application pressure of the thread on element 16 is less than the reset force generated by the magnet 8, so that contacts 14, 15 can open again. Transistor 20 will thus block, transistor 21 will become conductive, and full voltage will again be applied to coil 4. This will cause increased pressure of the brake disk 7 applied on thread 17, and the cycle will repeat.

Lever 11 need deflect only for very small distances to open and close contacts 14, 15. Thus, lever 11 and the current flowing through coil 4 will move at relatively high frequency. In actual practice, frequencies of about 100 Hz, and thereabove, have been found to pertain. The coil 4 is thus energized and de-energized only briefly. Since a coil has inductivity, current will rise with time delay with respect to applied voltage; upon disconnection, a voltage of reverse polarity occurs which is short-circuited by the free-wheeling diode 23, so that the current drops in the coil with a time delay. If the coil 4 has an inductivity which is high with respect to the operating frequency, then the coil will act as an energy store, or as an integrator, respectively. Thus, in spite of the repetitive, cyclical ON-OFF control operation, the thread tension will not vary or vibrate in pulses, since the current through the coil 4 flows practically continuously and only varies slightly with an undulation frequency corresponding to the vibration frequency of the lever 11, and hence of the switch contacts 14, 15. This frequency is further affected by the mass of the brake disk 7 and the elasticity of the thread 17, and is integrated thereby, so that the actual variations in tension at the thread are minor and the thread tension is practically flat and highly uniform.

Power switching transistor 21 operates in ON-OFF mode. Thus it has hardly any electrical losses, heating problems are avoided and high efficiency is obtained. This is of substantial importance if a large numer of such elements is used; let it be assumed 2500 such units are connected to a textile machine; if each one of them has thermal resistance losses of 1 watt per unit, the control unit 34 would have to provide 2.5 kilo watts for all the elements. Customary linear proportional controllers have circuits in which the operating voltage is distributed over a control transistor and the coil; this causes temperature problems, requires heat radiators and heat sinks and, overall, results in poor efficiency. The ON-OFF operating characteristics of the circuit of the present invention, corresponding to binary operation, avoid these problems.

Figure 3:
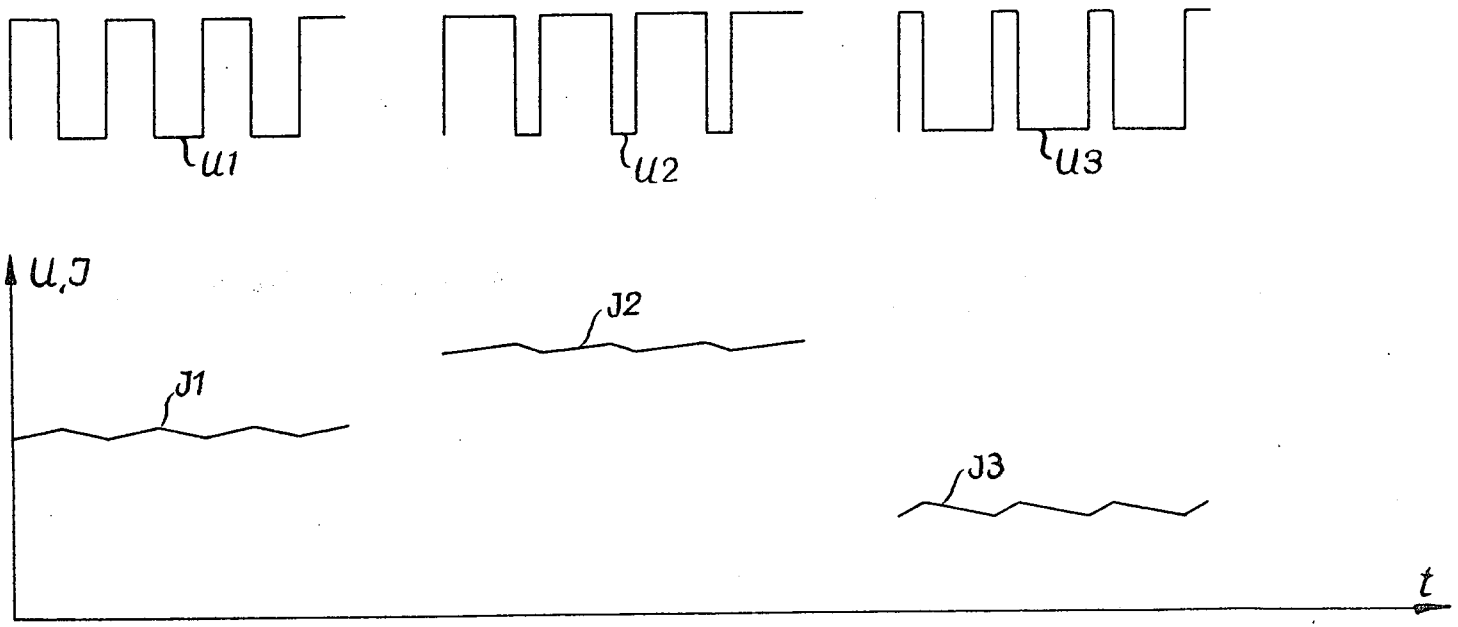
FIG. 3 is a graphic illustration of voltage and current curves arising in the circuit of FIG. 2 under different operating conditions.

FIG. 3 illustrates voltage and current curves in the coil 4 for different operating conditions. These curves are relative and are provided for explanation only and are not representative of accurate or absolute values of amplitude and time. If an average thread tension is set on the command unit 34 by adjustment of knob 38, and the system is operating properly, is new, and in accordance with design values, a roughly symmetrical square wave voltage U1 will be applied across coil 4. Due to the integrating and storage characteristics of the inductivity of coil 4, a current J1, corresponding to an average value, will flow in coil 4. This current determines the thread tension. Should the thread tension, and thus the application pressure on the lever 11 drop, contacts 14, 15 will close only when the brake causes a higher tension on thread 17 due to greater current in coil 4. The coil, therefore, will be connected for a longer period of time to the voltage in order to reach the necessary current, so that an unsymmetrical square wave voltage U2 with increased connecting period, or increased duty cycle, will result. The average value of current in shown at curve J2; the current through coil 4 as can be seen, will have a higher level than that of the current J1. If, however, the pull-off tension should increase with respect to commanded value, then the effective drag contributed by the electromagnetic brake must be less, requiring a smaller current through coil 4. This smaller current J3 is obtained due to the shorter period of time that the voltage is applied to coil 4, resulting in a square wave U3 having a decreased duty cycle, and resulting in a lower than average current value.

The control conditions between commanded value and actual value are thus satisified by means of this simple arrangement. Control is rapid and even large changes in thread tension are compensated within a few periods or cycles of the vibrating frequency of lever 11. This is very important for practical applications in which yarn passage may reach speeds of between 10 to 20 meters per second and frequently short-term thread tension changes result due to poor winding of the yarn packages supplying the yarn.

The control loop itself is closed by the yarn 17; the command value as set by adjustment knob 38 determines the reset force of magnet 8 and thus does not change. The braking or pinch effect of the brake 6, 7 is automatically controlled to provide proper yarn tension as set by the commanded reset force.

The circuit of FIG. 2 can easily be expanded to provide not only tension control but, additionally, supervision of the presence or absence and proper run of the thread itself. The circuit S2 between the chain-dotted lines is used for that purpose. The square wave U1, U2, or U3, respectively, is applied to a coupling capacitor 24, rectified in a rectifier formed of diodes 25, 26 and applied over resistor 27 to a capacitor 28. The rectification is in such direction that the capacitor 28 is positively charged. Upon positive voltage across the base of a transistor 30, the transistor 30 will become conductive, thus effectivly placing its collector at the voltage of terminal 35. No voltage will, therefore, appear across diode 32 at the terminal 33. If the thread should break or run out, contacts 14, 15 will remain open and coil 4 will no longer have a square wave alternating voltage applied thereto. The capacitor 28 can now discharge over the parallel resistor 29. This causes blocking of transistor 30 and the voltage at the collector of transistor 30 will be approximately that of terminal 36. The positive voltage from terminal 36 is now applied over resistor 31 and diode 32 to terminal 33 to there trigger an alarm stage to stop motion of the machine. Additional alarm signals can be provided. Terminal 33 therefore is an alarm signal terminal to control operation of the machine if the thread should break or run out. An alarm signal will also be provided if, due to abnormally high thread tension, contacts 14, 15 will not open at all; this condition will also inhibit formation of an alternating signal and thus discharge of capacitor 28 and an alarm signal at terminal 33. Permanently closed state of the contacts 14, 15 may arise not only due to abnormally high thread tension, as the thread is pulled off the supply reel; it may also occur due to a jammed brake, as well as other mechanical or electrical defects. The thread brake and control system combination is thus essentially fail-safe; the system is self-controlling with respect to defects. To disconnect the machine, it is only necessary to provide a relay and the terminals 33 of a plurality of such systems can be logically connected, for example through OR-gates, to such a relay.

After disconnecting the machine, threads will hang through, that is, will be relieved of tension. Upon renewed start-up of the machine, the system would, therefore, immediately again disconnect the machine. It is, therefore, customary to provide a delay relay which energizes the thread control circuits only when the machine is in full steady-state operation, and has already pulled yarn or thread thereinto, so that all threads are reliably tensioned. Such a time delay relay is preferably used also in connection with the system of the present invention upon start-up of the machine.

Various changes and modifications may be made within the scope of the inventive concept.

I claim:

1. Thread tension control apparatus to control the tension of thread (17) being supplied to a textile machine having a thread brake including a pair of pressure disks (6, 7) adapted to have the thread passed therebetween, and a pressure electromagnet (3, 4, 5) acting on at least one of the disks (7) to press the disks together with a force dependent on the energization of the magnet, to thus control the tension of thread passing between the disks, said apparatus comprising an oscillating lever (11) engaged by the thread (17) and urged by tension of the thread from a first position into a deflected position;

a reset electromagnet (8, 9, 10) acting on the lever (11) and, when energized, tending to move the lever to the first position and counter to the deflection position;

means (37, 38) adjustably energizing the reset electromagnet (8, 9, 10);

contact means (14, 15) operated by the lever (11), the lever (11) switching the contact means between open and closed position as the lever moves between deflected and first position;

a control circuit (S1) connected to the coil (4) of the pressure electromagnet (3, 4, 5) and connected to and controlled by the contact means (14, 15) to repetitively energize and de-energize the coil (4) of the pressure electromagnet (3, 4, 5), the coil (4) of the pressure electromagnet being de-energized when the lever (11) is moved to deflected position due to increased tension on the thread, permitting the reset elctromagnet to move the lever (11) to first position upon de-energization of the coil and to re-energize the coil (4) to increase tension and thereby cause the lever to oscillate as thread is pulled from between the pressure disks (6, 7) and the pull-off tension moves the lever (11) against the electromagnetic force of the reset electromagnet (8, 9, 10) as controlled and adjusted by said adjustable energizing (37, 38).

2. Apparatus according to claim 1, wherein the lever (11) is a double-armed lever, one arm carrying said contact means (14, 15) and the other arm forming a movable armature for said reset electromagnet (8, 9, 10).

3. Apparatus according to claim 1, further comprising a stop motion circuit (S2) connected to and controlled by said control circuit (S1), sensing cessation of oscillations of said lever and, upon such sensing, providing an alarm signal.

4. Apparatus according to claim 1, further comprising a single support plate (1) carrying the pressure electromagnet (3, 4, 5) and the reset electromagnet (8, 9, 10) and support means (13) for said lever (11).

5. Apparatus according to claim 1, wherein said lever (11) carries one of said contact means (14);

means (13) are provide supporting said lever on the apparatus;

and means (12) movably securing the arm (11) to said support means, said arm, said securing means and support means forming a current path for the contact (14) on the lever (11).

6. Apparatus according to claim 1, wherein the control circuit (S1) includes a switching amplifier (20, 21) connected between the coil (4) of the pressure electromagnet and the contact means (14, 15).

7. Apparatus according to claim 1, further comprising a free-wheeling diode (23) connected in parallel with the coil (4) of the pressure electromagnet (3, 4, 5).

8. Apparatus according to claim 3, wherein an alarm signal generating circuit (S2) is provided to generate the alarm signal, and comprises a rectifier (25, 26), a capacitor (24) coupling the rectifier to the control circuit (S1) to couple thereto only signals having alternating characteristics;

and an electronic switch (28, 29, 30) responsive only to a-c signals, said electronic switch providing an alarm output signal upon absence of a-c signals being applied thereto.

* * * * *